US007825801B2

(12) United States Patent
Woods

(10) Patent No.: US 7,825,801 B2
(45) Date of Patent: Nov. 2, 2010

(54) SECURITY SWITCH ASSEMBLIES FOR SHIPPING CONTAINERS AND THE LIKE

(75) Inventor: Randall Woods, Sun Lake, AZ (US)

(73) Assignee: Magnasphere Corporation, Brookfield, WI (US)

( * ) Notice: Subject to any disclaimer, the term of this patent is extended or adjusted under 35 U.S.C. 154(b) by 1049 days.

(21) Appl. No.: 11/372,165

(22) Filed: Mar. 9, 2006

(65) Prior Publication Data

US 2010/0238028 A1 Sep. 23, 2010

(51) Int. Cl.
*G08B 13/08* (2006.01)

(52) U.S. Cl. ..... 340/547; 340/545.1; 340/686.1

(58) Field of Classification Search ..... 340/545.1, 340/545.2, 547, 686.1, 686.6, 693.5, 693.12; 335/205, 206, 207, 133; 292/251.5, 92
See application file for complete search history.

(56) References Cited

U.S. PATENT DOCUMENTS 4,652,028 A * 3/1987 Logan et al. ..... 292/251.5
4,703,962 A * 11/1987 Kelly et al. ..... 292/251.5
5,332,992 A 7/1994 Woods
5,530,428 A 6/1996 Woods
5,668,533 A * 9/1997 Jackson et al. ..... 340/547
5,673,021 A 9/1997 Woods
5,877,664 A 3/1999 Jackson, Jr.
5,977,873 A 11/1999 Woods
6,603,378 B1 8/2003 Collins
7,046,109 B2 * 5/2006 Lee ..... 335/133

* cited by examiner

*Primary Examiner*—Van T. Trieu
(74) *Attorney, Agent, or Firm*—Hovey Williams LLP

(57) ABSTRACT

Switch-controlled security assemblies (20, 76) are provided which are especially designed for use with cargo enclosures (40), in order to detect any unauthorized opening of the cargo doors (38). The assemblies (20, 76) include one or more switch assemblies (26, 28) each having a switch member (44) and an associated shiftable component (46). In preferred forms, the switch member (44) includes a pair of switch elements (50, 52) and a body (54) movable between a first position in simultaneous electrical contact with the elements (50, 52), and a second position out of such simultaneous contact. The body (54) and components (46) are magnetically coupled such that movement of the component (46) during unauthorized opening of door (38) effects corresponding movement of the body (54), in turn actuating an alarm controller (30).

28 Claims, 6 Drawing Sheets

FIG. 1.
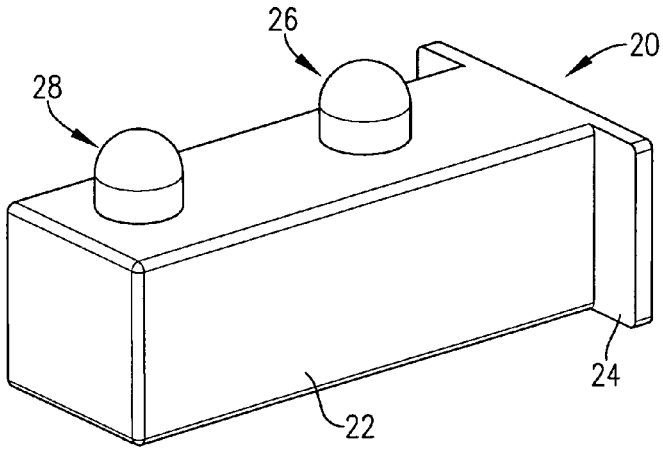
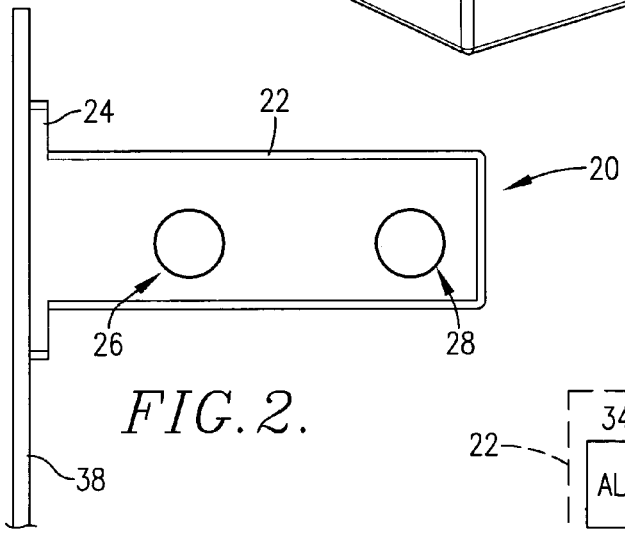
FIG. 2.
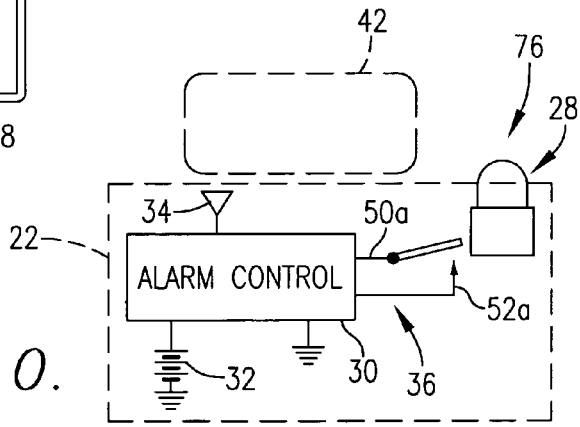
FIG. 10.
FIG. 6.
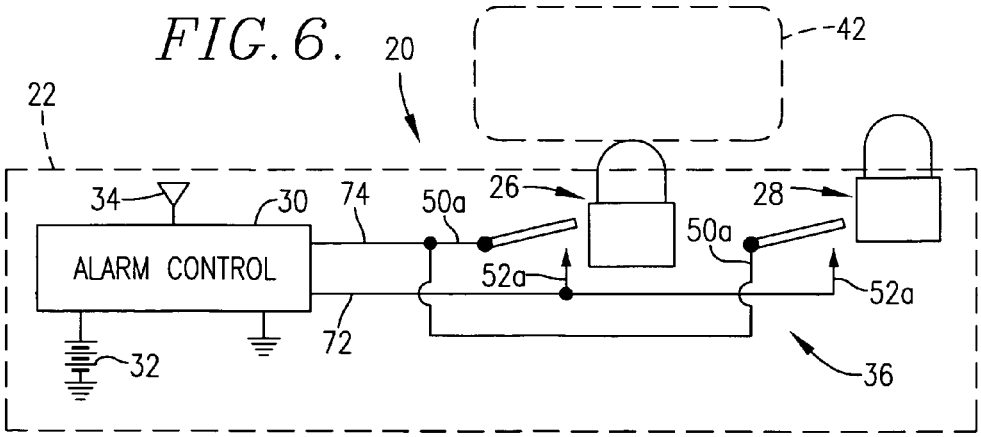

SECURITY SWITCH ASSEMBLIES FOR SHIPPING CONTAINERS AND THE LIKE

BACKGROUND OF THE INVENTION

1. Field of the Invention

The present invention is broadly concerned with security assemblies adapted for connection to doors or similar movable objects, in order to provide an alarm function in the event of unauthorized opening of the doors. More particularly, it is concerned with such security assemblies, as well as switch assemblies forming a part thereof wherein the security assemblies have one or more switch assemblies each having a magnetically operated switch member.

2. Description of the Prior Art

Prior art security alarm systems often make use of magnetic switches attached to doors and windows which are integrated within a system for detecting unauthorized openings. One common type of magnetic switch used in these situations is a so-called reed switch. Reed switches are subject to unauthorized manipulation through use of an external magnet, allowing an intruder to open a door or window without triggering the alarm system.

A number of magnetic switches have been proposed in the past to overcome deficiencies of reed switches. U.S. Pat. Nos. 5,977,873, 5,530,428, 5,332,992, 5,673,021, and 6,603,378 describe switches having a pair of spaced apart switch elements with a shiftable body (e.g., a spherical ball) movable between a first position where the ball is in simultaneous contact with both switch elements, and a second position out of such simultaneous contact. An alarm circuit is operatively coupled with the switch element so as to detect movement of the body and a corresponding change in electrical state of the switch element, which in turn triggers an alarm function.

Cargo containers which are moved or shipped over long distances present a significant security problem. For example, unless properly protected, such containers may be opened en route and the contents thereof stolen. Also, such containers could be opened and a bomb or other terrorist device inserted therein. Accordingly, it is very important that such containers be secured against unauthorized access. One problem in this regard is that most prior security systems require a source of AC power, which is not feasible when seeking to protect shipping containers.

SUMMARY OF THE INVENTION

The present invention overcomes the problems outlined above and provides security assemblies especially adapted for use with shipping containers having a cargo enclosure presenting a doorway, and with a door operably coupled adjacent the doorway. Broadly speaking, such security assemblies include at least one switch assembly mounted on either the door or the doorway. The switch assembly includes a switch member having a first switch element, a second switch element in spaced relationship to the first element, and an electrically conductive body shiftable between a first body position in contact with the first and second switch elements and defining a first switch state, and a second body position out of the simultaneous contact with the first and second switch elements and defining a second switch state. A shiftable component is located proximal to the switch member and is movable between first and second component positions. The shiftable component and proximal switch member body are being magnetically coupled such that movement of the component between the first and second component positions effects corresponding movement of the body between the first and second body positions in order to change the state of the switch member. The overall security assembly also has an alarm controller and circuitry operably coupling the at least one switch member and the alarm controller in order to initiate an alarm upon unauthorized opening of the door. The switch member is oriented such that upon the unauthorized opening of the door, the component is shifted between the component positions thereof, and the switch member changes state, thereby actuating the alarm controller.

In preferred forms, each switch member body comprises a substantially spherical ball, which is located within a metallic switch housing. The first switch element is in the form of an electrode extending into the housing, while the second switch element comprises at least a portion of the conductive housing. The shiftable component preferably is in the form of a spring-biased plunger.

In order to provide the magnet coupling between the shiftable body and component, one of the body or component is permanently magnetized while the other is formed of a complemental permanently magnetized material or an appropriate material which is magnetically susceptible.

The security assemblies of the invention are normally self-contained, and include a battery for actuation of the alarm controller. An antenna may also be provided with the controller in order to transmit alarm signals to a remote location. If desired, after such a signal is received, the container could be tracked using conventional GPS technology.

BRIEF DESCRIPTION OF THE DRAWINGS

FIG. 1 is a perspective view of a dual-switch security assembly in accordance with the invention;

FIG. 2 is a plan view of the assembly of FIG. 1, shown mounted on a container door;

FIG. 6 is a schematic view illustrating the connection between the dual switches of the security assembly and an alarm controller, and the electrical states of the dual switches in the closed door position;

FIG. 10 is a schematic view similar to that of FIG. 6, showing the electrical connection between an alarm controller and the single switch security assembly of FIGS. 7-9.

DETAILED DESCRIPTION OF THE PREFERRED EMBODIMENT

Figure 3:
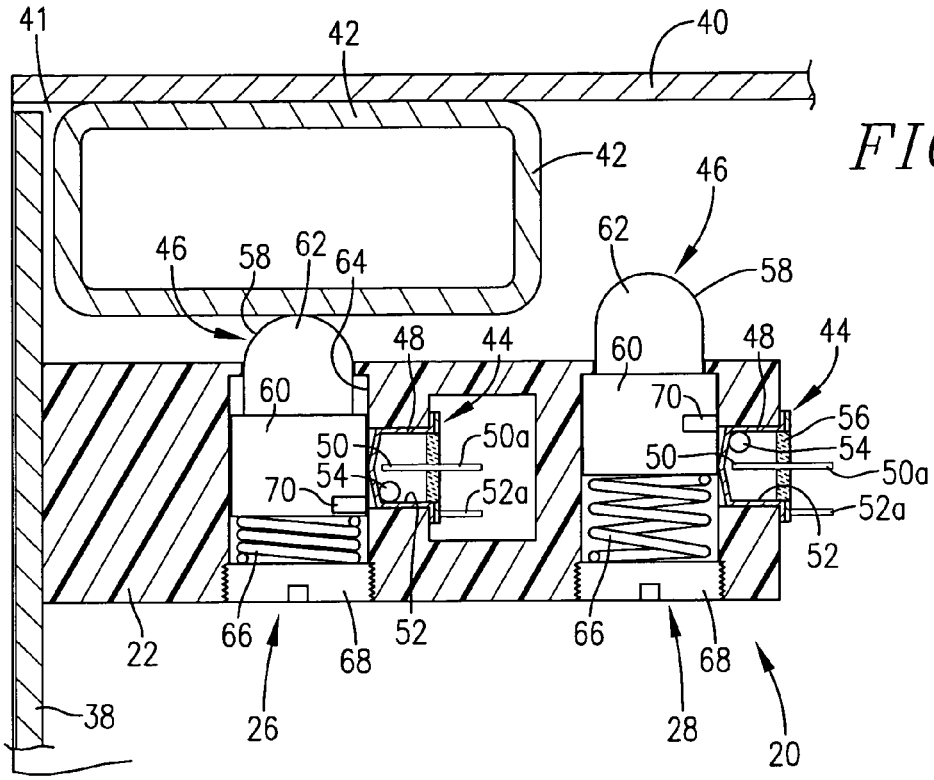
FIG. 3 is a schematic, vertical sectional view illustrating the assembly of FIG. 1, mounted on a container door, and showing the electrical states of the dual switches in the closed door position.

Turning now to the drawings, a security assembly 20 in accordance with the invention is illustrated in FIGS. 1-6. The assembly 20 includes a housing 22 and a lateral butt mounting flange 24. Internally, the assembly 20 has a pair of switch assemblies 26, 28, an alarm controller 30 (FIG. 6) equipped with a battery 32 and an antenna 34, and circuitry 36 operably coupling the controller 30 and switches 26, 28. The assembly 20 is especially adapted for mounting on a swingable door 38, and especially a door associated with a cargo enclosure 40 (e.g., the trailer of a tractor-trailer rig, or a shipping container). Such containers universally include a doorway 41, and a metallic stiffener or header 42 along the upper margin of the doorway 41.

In more detail, the switch assemblies 26, 28 are in most respects identical, each including a switch member 44 and a shiftable component 46. Each switch member 44 has a small, preferably metallic switch housing 48 with a pair of switch elements 50, 52 and an electrically conductive body 54 located within the housing 48. The housing 48 also has an insulative cover 56 disposed over the open end thereof. These switch members are similar to the magnetic switch units described in U.S. Pat. No. 6,603,378.

In the form shown, the switch element 50 of each member 44 is an elongated, electrically conductive electrode which extends through cover 56 and into the confines of switch housing 48, whereas the element 52 is a portion or all of the conductive housing 48. In order to allow electrical connection of the switch assembly to controller 30, leads 50*a* and 52*a* are provided. In preferred forms, the body 54 is substantially spherical and is formed of ferromagnetic or other magnetically susceptible material.

Each component 46 is in the form of a shiftable plunger 58 having a base 60 and a rounded, outboard plunger end 62. Each plunger 58 is shiftable within a bore 64 in housing 22 adjacent the associated switch member 44. The plungers 58 are biased upwardly by means of a coil spring 66 situated beneath each base 60 and a stop 68 threaded into housing 22. Each plunger base 60 carries a small permanent magnet 70 therein at a location closely adjacent to the associated switch housing 48. In this manner, and as more fully described below, each magnet 70 and adjacent body 54 are magnetically coupled so that the movement of the plunger magnet 70 effects corresponding movement of the body 54 within the associated switch housing 48. It will be observed in this respect that the magnet 70 forming a part of switch assembly 26 is located adjacent the bottom of base 60, whereas the magnet 70 forming a part of switch assembly 28 is placed above the bottom of the base 60. The importance of this relative offset between the positions of the magnets 70 will be made clear hereafter.

The circuitry 36 is designed to operably connect the switch assemblies 26 and 28 with controller 30. To this end, the circuitry 36 includes a common conductor 72 leading from controller 30 and electrically connected with the leads 52*a* forming a part of the switch assemblies 26 and 28. Additionally, a conductor 74 is provided, extending from controller 30 and electrically connected with the leads 50*a*. In this fashion, the switch assemblies are coupled in parallel, but a variety of other wiring schemes could also be employed.

Figure 4:
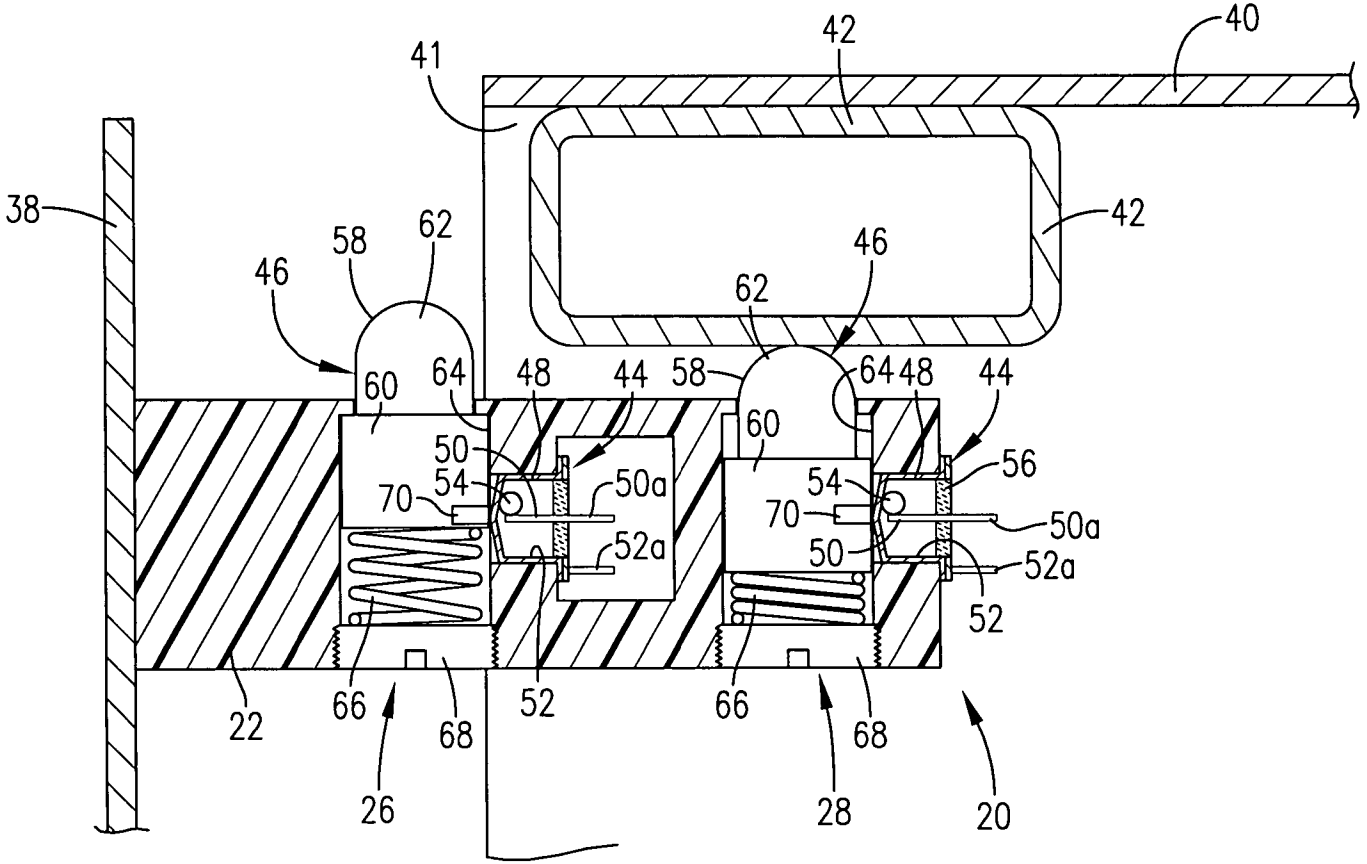
FIG. 4 is a view similar to that of FIG. 3, but showing the electrical states of the dual switches during opening of the container door.
Figure 5:
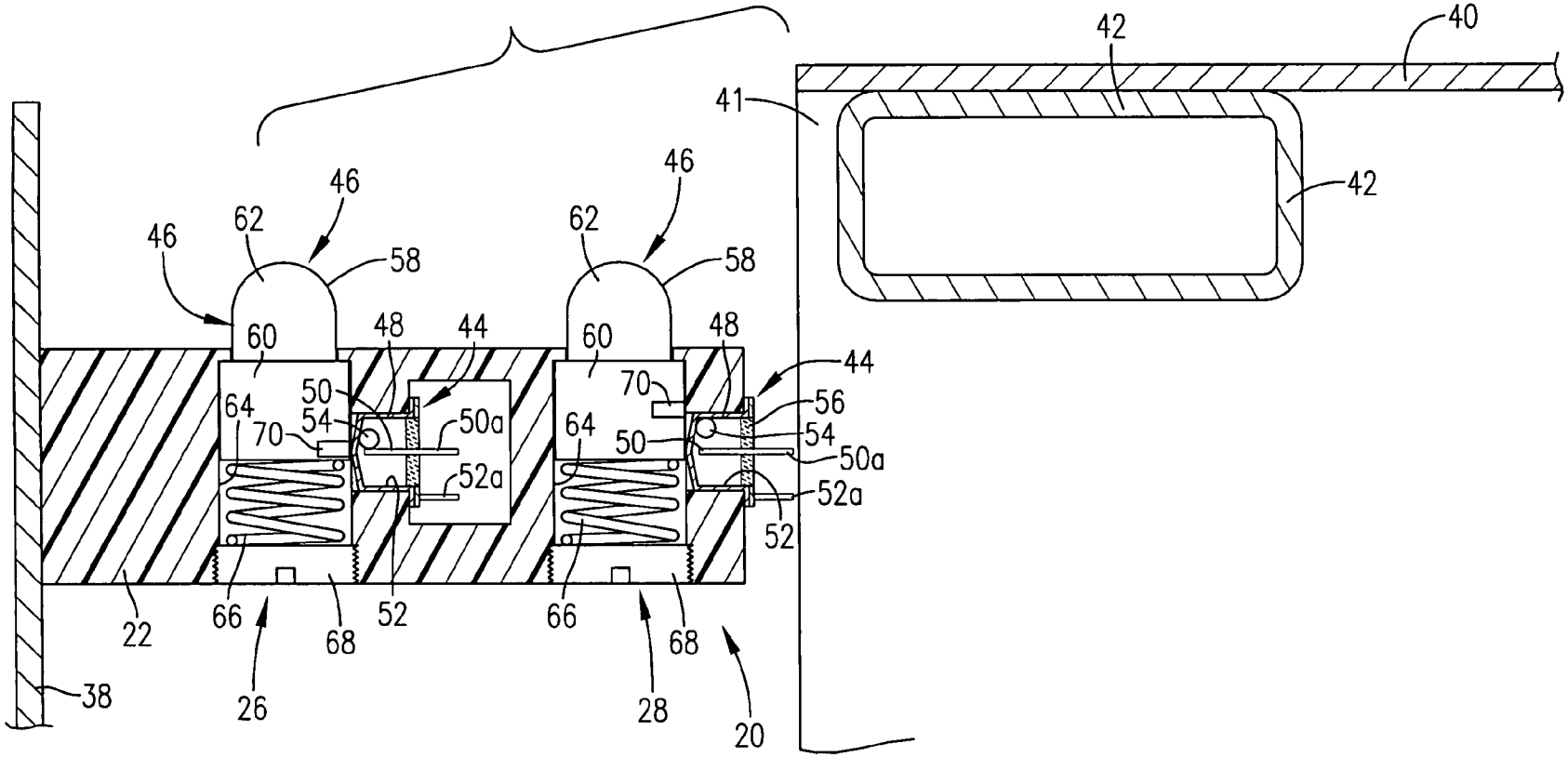
FIG. 5 is a view similar to that of FIG. 4, but showing the electrical states of the dual switches in the door open position.

Attention is next directed to FIGS. 3-5 which illustrate the operation of assembly 20 when mounted on the door 38 of a cargo enclosure 40, the latter having the usual header 42. Referring first to FIG. 3, the assembly 20 is illustrated in a position corresponding to full closure of door 38. In this configuration, it will be observed that the plunger 58 of assembly 26 is shifted downwardly owing to the engagement between the plunger end 62 and the underside of header 42. Also, the plunger 58 forming a part of the assembly 28 is in its full-up position, having cleared the header 42. As a consequence of these relative positions of the plungers 58, it will be seen that the magnetically coupled bodies 54 are both out of simultaneous contact with the associated switch elements 50 and 52. Normally, this would constitute a "switch-open" state for the assemblies 26 and 28. In this preferred door-closed orientation, the alarm controller 30 remains non-energized, because of the switch assemblies are open (see FIG. 6).

During opening of door 38 (FIG. 4), the switch assembly 26 first clears header 42 and the associated plunger 58 is biased upwardly by spring 66. At the same time, the plunger 58 forming a part of assembly 28 passes beneath header 42 and is depressed. This changes the electrical states of both of the switch assemblies 26 and 28. That is, the upward movement of magnet 70 of assembly 26 causes the magnetically coupled body 54 to come into simultaneous contact with the elements 50 and 52, and likewise the downward movement of magnet 70 of assembly 28 causes the magnetically coupled body 54 to move downwardly for simultaneous contact with the elements 50 and 52. Thus, both assemblies 26 and 28 are in the "switch-closed" position, which actuate controller 30. Generally, the controller 30 would be coupled to a perceptible alarm (e.g., a horn or warning light) to create a warning condition that the door 38 has been opened. In addition, a warning signal could be broadcast by the controller 30 through antenna 34 to a remote location.

FIG. 5 depicts the orientation of assembly 20 when the door 38 is fully opened. In this condition, both of the plungers 58 are in their fully extended positions. This, in turn, causes the body 54 of assembly 26 to remain in its "switch-closed" position. However, full extension of the plunger 58 of assembly 28 causes the magnetically coupled body 54 to move upwardly, out of simultaneous contact with the switch elements 50, 52 to the "switch-open" position. It will be seen that the electrical states of the assemblies 26 and 28 are different when the door 38 is fully closed, versus the full open position of the door. That is, in the door-closed position of FIG. 3, both of the switch assemblies 26, 28 are in the "switch-open" position, whereas in the door-open position of FIG. 5, switch assembly 26 is in the "switch-closed" position, while switch assembly 28 is in the "switch-open" position. Thus, if desired, the controller 30 may be equipped with circuitry which discriminates between the switch states, thereby allowing monitoring of whether the door is fully closed or fully opened.

Figure 7:
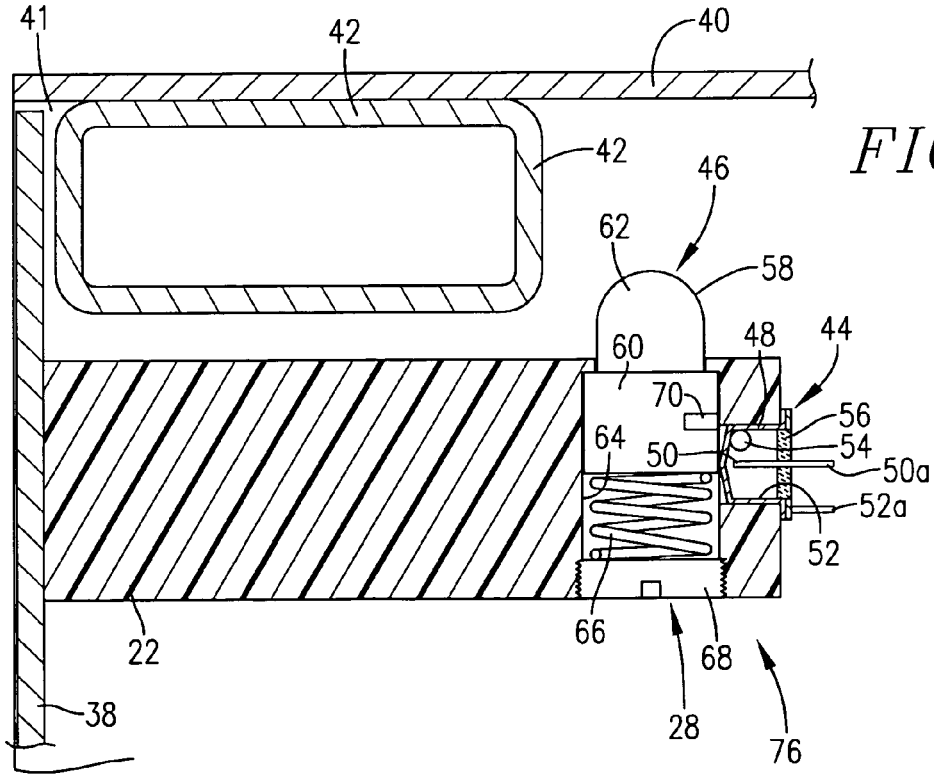
FIG. 7 is a view similar to that of FIG. 3, illustrating a single switch security assembly in accordance with the invention.
Figure 8:
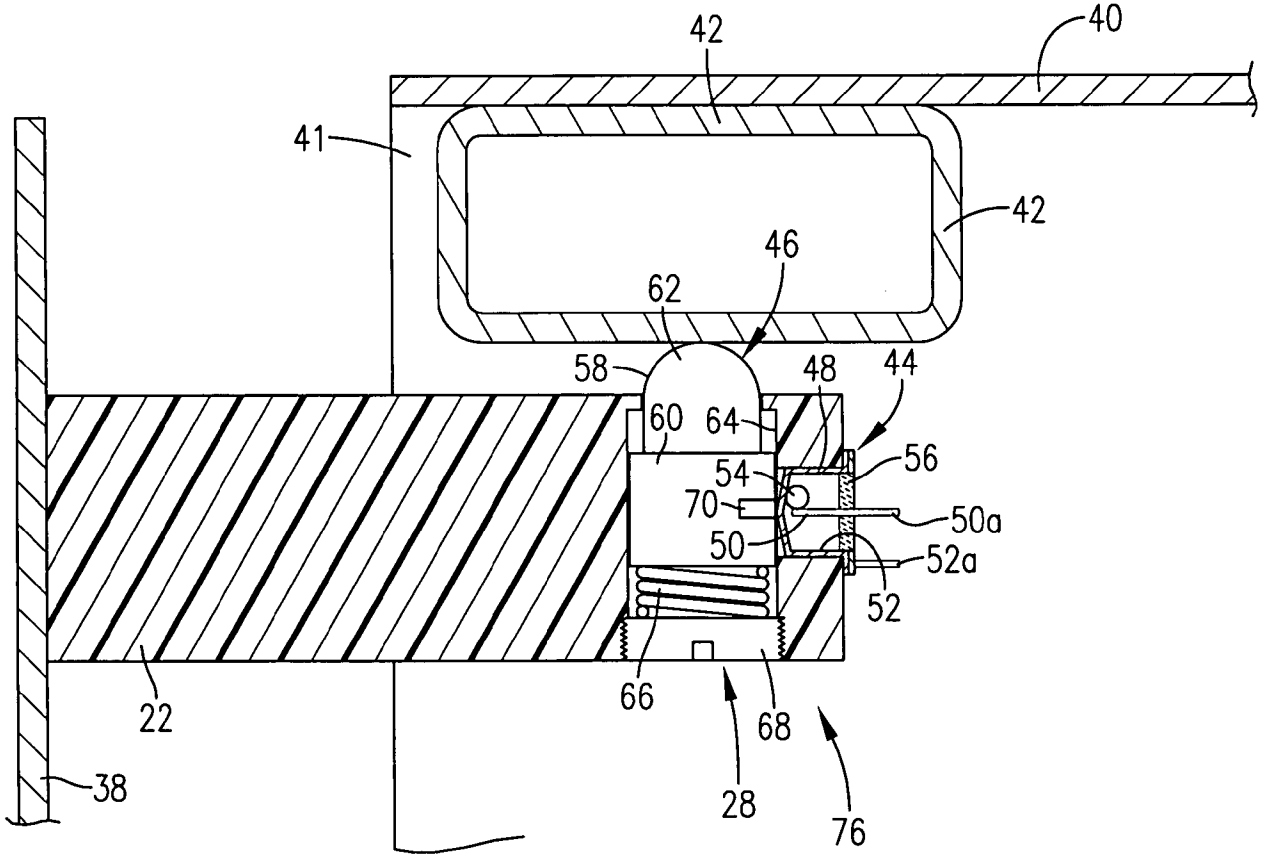
FIG. 8 is a view similar to that of FIG. 7, but showing the electrical state of the single switch during opening of the door.
Figure 9:
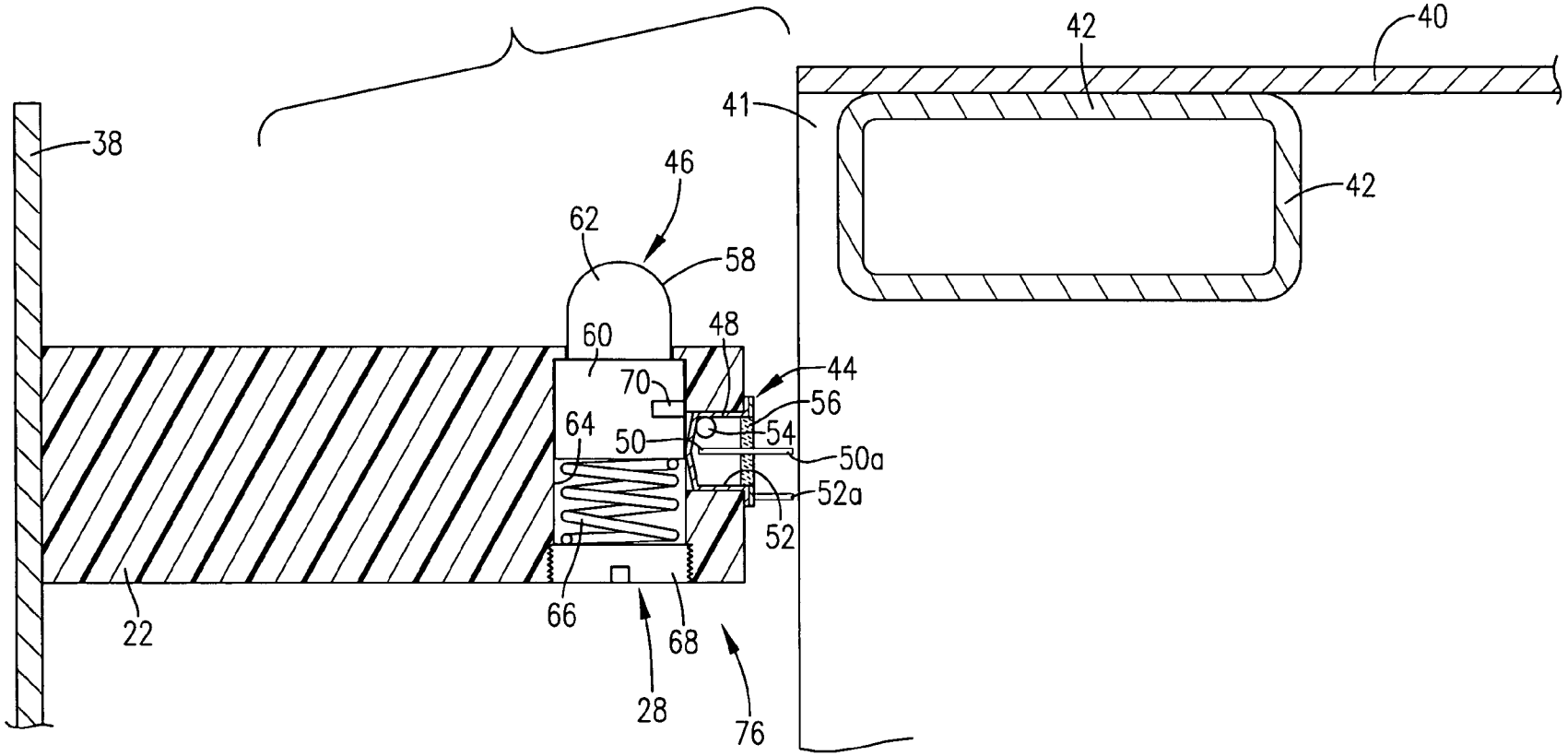
FIG. 9 is a view similar to that of FIG. 8, but showing the electrical state of the single switch in the door open position.

FIGS. 7-10 depict a modified security assembly 76, which is in many respects similar to assembly 20 save for the fact that it includes only a single switch assembly 28. Accordingly, like components between the assemblies 20 and 76 are identically numbered. As shown in FIGS. 7-9, the assembly 76 is mounted on a container door 38.

In the door-closed position of FIG. 7, the plunger 58 is fully extended, such that the magnet 70 causes the magnetically coupled body 54 to move upwardly and remain at the "switch-open" position out of simultaneous contact with the elements 50, 52. As the door 38 is partially opened, the plunger 58 is depressed owing to the engagement between the plunger and the underside of header 42; this causes the magnet 70 to move downwardly, thereby moving the magnetically coupled body 54 into the "switch-closed" position in simultaneous contact with the switch elements 50, 52. This also causes energization of alarm controller 30 and initiation of a warning alarm. In this embodiment, the controller 30 would typically be designed so that, once energized, it would not stop the alarm sequence until properly reprogrammed. When the door 38 is fully open (FIG. 9), the plunger 58 again assumes its fully extended position, thereby causing the magnetically coupled body 54 to move to the "switch-open" position. However, as explained, this does not terminate operation of the alarm function initiated during partial opening of the door 38.

As explained, in the preferred embodiments of the invention, the plungers 58 carry permanent magnets 70, and the shiftable bodies 54 are formed of a material which is magnetically susceptible (e.g., steel). However, this arrangement is not essential, and it is only required that the shiftable component and the shiftable body be magnetically coupled. As such, both of these parts could be formed from permanently magnetic material, or the bodies may be permanent magnets while the associated shiftable components could be formed of magnetically susceptible material.

In the preferred forms, the first switch assembly positions where the bodies 54 are in simultaneous contact with the switch elements are "switch-closed" positions, while the second switch assembly positions where the bodies 54 are out of simultaneous contact with the switch elements are "switch-open" positions. This arrangement is not essential, though, and those skilled in the art will appreciate that the switch assemblies can be configured so that the switch positions correspond to different electrical states.

I claim:

1. A security assembly adapted for protecting a door mounted adjacent a doorway and movable between open and closed positions, said security assembly comprising:

at least one switch assembly adapted to be mounted on one of said door and doorway and comprising:

a switch member including a first switch element, a second switch element in spaced relationship to the first element, and an electrically conductive body shiftable between a first body position in contact with the first and second switch elements and defining a first switch state, and a second body position out of said simultaneous contact with the first and second switch elements and defining a second switch state;

a shiftable component proximal to said switch member and movable between first and second component positions, said component and switch member body being magnetically coupled such that movement of the component between said first and second component positions effects corresponding movement of said body between the body positions in order to change the state of said switch member;

an alarm controller; and circuitry operably coupling said at least one switch member and said alarm controller in order to initiate an alarm upon unauthorized opening of said door, said switch member oriented such that upon said unauthorized opening of said door, said component is shifted between the component positions thereof, said switch member changes state, and said controller is actuated.

2. The security assembly of claim 1, said switch member body comprising a substantially spherical ball.

3. The security assembly of claim 1, said switch member including a switch housing having said body therein, said first element comprising an electrode extending into said housing, said second element comprising at least a portion of said housing.

4. The security assembly of claim 1, said component comprising a spring-biased plunger.

5. The security assembly of claim 1, at least one of said switch member body and at least a part of said component being formed of magnetic material.

6. The security assembly of claim 5, said component carrying a permanent magnet which is magnetically coupled with said switch member body.

7. The security assembly of claim 1, including a plurality of said switch members mounted in spaced relationship to each other.

8. The security assembly of claim 1, said switch member adapted to be mounted on said door, and said component engageable with a portion of said doorway.

9. The security assembly of claim 1, said switch element body being in the second position thereof when said door is closed.

10. The security assembly of claim 1, including a battery operably coupled with said controller.

11. The security assembly of claim 1, said switch member and controller located within a common assembly housing.

12. The security assembly of claim 1, including a pair of spaced apart switch members carried within a common assembly housing and adapted to be mounted on said door, said switch members being located such that, when the door is closed, the switch member bodies are each in the second position thereof.

13. The security assembly of claim 12, said switch members being located such that, as said door is opened, the switch member bodies are each in the first position thereof.

14. The security assembly of claim 12, said switch members being located such that when the door is opened, one of the switch member bodies is in the first position thereof, and the other switch member body is in the second position thereof.

15. The combination comprising:

a shipping container or the like having a cargo enclosure defining a doorway, and a door operably coupled with the container adjacent said doorway and movable between an open and a closed position;

a security assembly operably coupled with said container and comprising:

at least one switch assembly mounted on said door or said enclosure, including a switch member having a first switch element, a second switch element in spaced relationship to the first element, and an electrically conductive body shiftable between a first body position in contact with the first and second switch elements and defining a first switch state, and a second body position out of said simultaneous contact with the first and second switch elements and defining a second switch state;

a shiftable component proximal to said switch member and movable between first and second component positions, said component and switch member body being magnetically coupled such that movement of the component between said first and second component positions effects corresponding movement of said body between the body positions in order to change the state of said switch member;

an alarm controller; and circuitry operably coupling said at least one switch member and said alarm controller in order to initiate an alarm upon unauthorized opening of said door, said switch member oriented such that upon said unauthorized opening of said door, said component is shifted between the component positions thereof, said switch member changes state, and said controller is actuated.

16. The combination of claim 15, said switch member body comprising a substantially spherical ball.

17. The combination of claim 15, said switch member including a switch housing having said body therein, said first element comprising an electrode extending into said housing, said second element comprising at least a portion of said housing.

18. The combination of claim 15, said component comprising a spring-biased plunger.

19. The combination of claim 15, at least one of said switch member body and at least a part of said component being formed of magnetic material.

20. The combination of claim 19, said component carrying a permanent magnet which is magnetically coupled with said switch member body.

21. The combination of claim 15, including a plurality of said switch members mounted in spaced relationship to each other.

22. The combination of claim 15, said switch assembly mounted on said door, said component engageable with a portion of said doorway.

23. The combination of claim 15, said switch element body being in the second position thereof when said door is closed.

24. The combination of claim 15, including a battery operably coupled with said controller.

25. The combination of claim 15, said switch member and controller located within a common assembly housing.

26. The combination of claim 15, including a pair of spaced apart switch members carried within a common assembly housing and mounted on said door, said switch members being located such that, when the door is closed, the switch member bodies are each in the second position thereof.

27. The combination of claim 26, said switch members being located such that, as said door is opened, the switch member bodies are each in the first position thereof.

28. The combination of claim 26, said switch members being located such that when the door is opened, one of the switch member bodies is in the first position thereof, and the other switch member body is in the second position thereof.

* * * * *